United States Patent [19]

Glickman et al.

[11] 4,290,645

[45] Sep. 22, 1981

[54] STACKING CHAIR

[75] Inventors: Michael Glickman; Geoffrey A. Hollington, both of London, England

[73] Assignee: Pel Limited, Oldbury, England

[21] Appl. No.: 112,940

[22] Filed: Jan. 17, 1980

[51] Int. Cl.[3] ..... A47C 3/04

[52] U.S. Cl. ..... 297/239; D6/73

[58] Field of Search ..... 297/239, 234, 134, 232; D6/69, 75, 73, 56, 55; 108/91

[56] References Cited

U.S. PATENT DOCUMENTS

| | | | |
|---|---|---|---|
| D. 55,399 | 1/1920 | Riedep | D6/55 |
| D. 148,504 | 1/1948 | Vetter | D6/55 |
| D. 155,273 | 9/1949 | Eames | D6/55 |
| D. 183,478 | 9/1958 | Cohen | D6/55 |
| 1,989,426 | 1/1935 | Pollak | 108/91 X |

FOREIGN PATENT DOCUMENTS

| | | | |
|---|---|---|---|
| 882290 | 7/1953 | Fed. Rep. of Germany | 297/239 |
| 948007 | 8/1956 | Fed. Rep. of Germany | 297/239 |
| 2432542 | 1/1975 | Fed. Rep. of Germany | 297/239 |
| 822162 | 9/1937 | France | 297/239 |

*Primary Examiner*—James T. McCall

*Attorney, Agent, or Firm*—Andrus, Sceales, Starke & Sawall

[57] ABSTRACT

A stacking chair comprising a seat supported by a frame which includes a pair of splayed rear legs supporting the seat near its rear, the rear portion of the seat decreasing in width towards the rear, and the width at the front of the rear portion being greater than the separation of the rear legs adjacent their upper ends and the width of the rear portion at the back being equal to or less than the separation of the rear legs adjacent their upper ends.

3 Claims, 1 Drawing Figure

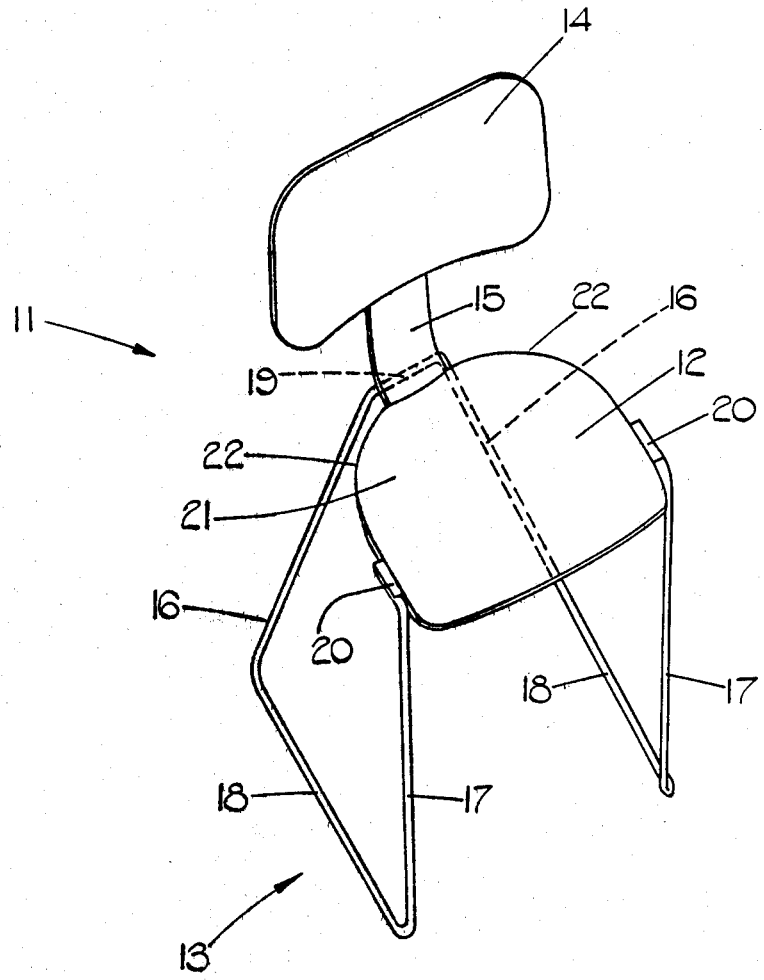
14
11
15
22
16
19
12
20
22
21
16
20
18
17
18
17
13

STACKING CHAIR

This invention relates to chairs which are capable of being stacked one upon another to enable them to be stored in minimum space.

According to the present invention a stacking chair comprises a seat supported by a frame including towards its rear, a pair of splayed legs, a rear portion of the seat decreasing in width continuously from front to back, the width at the front of the rear portion being greater than the separation between the rear legs adjacent their upper ends and the width at the back of the rear portion being equal to or less than the separation between the rear legs adjacent their upper ends.

Preferably the width of the rear edge of the seat is substantially equal to separation of the rear legs of the chair at their upper ends. In this manner as one chair is lowered upon another, the cam action between the rear legs of the upper chair and the rear portion of the seat of the lower chair will force the upper chair backwardly into a tight stacking relationship with the lower chair.

In order to achieve a tight degree of stacking, the front legs of the chair must also be arranged so that they lie beyond the edge of the seat of the underlying chair and lie in close proximity to the front legs of that chair, when stacked. One method of achieving this is to arrange that all the legs are positioned outboard of the seat. Furthermore, in order to achieve a tight degree of stacking the back portion of the chair and legs should be made as thin as is practical.

One embodiment of the present invention is described, by way of example only, with reference to the accompanying drawing which shows an isometric view of a stacking chair formed in accordance with the present invention.

As illustrated in the accompanying drawing, the stacking chair 11 comprises a laminated wooden seat 12 supported by a frame 13 formed from a single length of metal rod, and a laminated wooden back 14, the back 14 being secured to the seat 12 by a metal supporting plate 15. Instead of metal rod, the frame could be formed from metal tube.

The frame 13 defines a pair of rear legs 16 which are directed outwardly and rearwardly, from top to bottom. These rear legs 16 are connected together at their ends by a crossmember 19, each rear leg being connected at its lower end by one of a pair of parallel crossmembers 18, to the lower end of one of a pair of front legs 17. The front legs 17 are inclined forwardly from top to bottom and are parallel to one another, each being positioned inside the vertical axial plane of the associated cross member 18. The upper ends of the front legs 17 are attached to the seat 12 by means of brackets 20 which extend outwardly from the edges of the seat 12 and the cross member 19 is secured to the metal plate 15, so that the whole of the frame 13 lies outboard of the seat 12.

The edges of the rear portion 21 of the seat 12 are curved so that the width of the rear portion 21 decreases continuously from front to back, the width of the rear portion 21 at the front being slightly less than the separation of the rear legs 16 at their lower ends and the width of the rear portion 21 at the back being equal to the separation of the rear legs 16 at their upper ends, that is adjacent to the cross member 19.

When stacking chairs constructed as described, as one chair 11 is lowered upon another, the rear legs 16 of the upper chair will engage the curved surfaces 22 of the rear portion of the seat 12 of the lower chair. On continued downward movement of the upper chair, a cam action will result between the curved surfaces 22 and the rear legs 16, moving the upper chair rearwardly with respect to the lower chair, until the chairs are in a closely stacked relationship to one another. In this position the seat of the upper chair will rest upon that of the lower chair with the cross member 19 of the upper chair positioned against the back support plate 15 of the lower chair, so that the backs of the chairs will abut one another, the cross members 18 of the upper chair will overlie those of the lower chair and the rear legs 16 and forward legs 17 of the upper chair will lie against the forward edges of the rear legs 16 and front legs 17 respectively, of the lower chair.

Various modifications may be made without departing from the invention. For example, the seat and back portions may be formed as a single piece from suitably reinforced plastics material or from any other suitable material. Also the front and rear legs need not be formed from a single length of rod or tubing, but for example could be made from several lengths of rod or tube which are welded together or are interconnected by the seat 12 of the chair.

We claim:

1. A stacking chair comprising a seat (12), a backrest (14) connected to the rear edge of the seat, a frame for supporting the seat and including a pair of front legs (17) which are parallel to one another, and a pair of rear legs (16) which are inclined outwardly and downwardly, the rear portion (21) of the seat decreasing in width towards the rear of the chair, the seat width at the front of the said rear portion (21) being greater than the separation between the rear legs (16) at their upper ends and the maximum seat width at the rear of the said rear portion (21) being equal to the separation between the rear legs (16) at their upper ends so that a camming action occurs between the seat of one chair and the rear legs of a chair placed downwardly thereover to thereby move the last named chair rearwardly during stacking.

2. The stacking chair of claim 1, in which said front legs (17) and said rear legs (16) lie outside the periphery of said seat (12), and which includes a connector (15) joining said seat (12) and said backrest (14), the upper ends of said rear legs (16) being connected to said connector (15).

3. The stacking chair of claim 1 wherein said front and rear legs (17,16) are all formed from a single length of metal rod.

* * * * *